US006527573B2

(12) United States Patent
Stein, Sr. et al.

(10) Patent No.: US 6,527,573 B2
(45) Date of Patent: Mar. 4, 2003

(54) SLIDE CONTACT ELECTRICAL CONNECTOR

(75) Inventors: William L. Stein, Sr., Warren, OH (US); Mark D. McCall, Youngstown, OH (US); Raymond Arnold Maga, Poland, OH (US); Daniel R Rester, Satsuma, AL (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/862,907

(22) Filed: May 22, 2001

(65) Prior Publication Data

US 2002/0177341 A1 Nov. 28, 2002

(51) Int. Cl.[7] ..... H01R 13/15; H01R 13/62
(52) U.S. Cl. ..... 439/260
(58) Field of Search ..... 439/260, 635, 439/637, 263, 587, 589

(56) References Cited

U.S. PATENT DOCUMENTS 4,560,222 A * 12/1985 Dambach ..... 439/260

6,238,226 B1 * 5/2001 Schempp et al. ..... 439/260

* cited by examiner

*Primary Examiner*—Javaid Nasri
(74) *Attorney, Agent, or Firm*—Thomas N. Twomey

(57) ABSTRACT

A slide contact electrical connector preferably for an oxygen sensor is assembled in such a way as to protect the precious metal surface of multiple contact pads of an edge card 28. The edge card 28 is encased by a ceramic capsule 30. Trailing portions 54 of terminals 20 are laterally inserted into longitudinally extending channels 52 of a core 22 being radially and axially locked in place. The terminals 20 extend forward from the core 22 and are positioned about the trailing end 42 of the edge card 28 from a longitudinal direction. A collar 26 compresses the terminals 20 against the edge card 28 from a lateral direction thereby making the electrical contact. A shield 18 encircles the capsule 30, collar 26, terminals 20 and core 22 thereby protecting the electrical connection integrity. A seal 16 is disposed at a trailing end of the shield 18 penetrated by a plurality of insulated electrical wires 14.

11 Claims, 4 Drawing Sheets

SLIDE CONTACT ELECTRICAL CONNECTOR

TECHINICAL FIELD OF THE INVENTION

The present invention relates to an electrical connector, and more particularly to a slide contact electrical connector.

BACKGROUND OF THE INVENTION

Electrical connectors traditionally connect multiple terminals of a wiring harness to multiple contact pads of a circuit board or an edge card, of a sensor. One type of sensor is an oxygen sensor which when applied to an automotive exhaust pipe application, is exposed to relatively high temperatures. The edge card or planar element, is therefore insulated electrically with an encasement or capsule made of high temperature resistant material such as ceramic. A separate ceramic collar engages the encasement to protect the terminals and provide a seal about the insulated wires.

During assembly, the flexible terminals of the harness typically slide longitudinally onto the end of the planar element. Because of the rasping fit of the terminals to the multiple contact pads of the element, the abrasive longitudinal sliding action of the terminals has a tendency to damage the precious metal surface of the sensor contact pads. In addition, as the terminals engage the planar element, the insulated wires of the harness must slide through a portion of the ceramic capsule. Unfortunately, the ceramic material is hard and may present sharp protrusions and edges which can damage the insulation of the wiring harness.

SUMMARY OF THE INVENTION

The present invention provides a slide contact electrical connector for a planar element or edge card with multiple contact pads. The planar element or edge card is encapsulated by an elongated ceramic capsule. The element has a leading end which penetrates a leading surface of the capsule and a trailing end having multiple contact pads exposed laterally through a trailing portion of the capsule. A plurality of terminals are placed laterally within respective longitudinally extending grooves of a connector core. A leading or cantilevered portion of each terminal extends axially forward of the core to electrically engage each respective contact pad disposed on the planar surface of the edge card or planar element. The electrical engagement is affirmed by a collar which preferably slides axially forward from the core to the trailing portion of the capsule and over the terminals. The terminals are thereby forced laterally against the planar element making the electrical engagement.

A feature of the invention is the protection of the precious metal surface of the planar element during electrical connection of the terminals to the element.

Another feature of the invention is the avoidance of nicking or cutting the rubberized insulation of the harness wire by the sharp ceramic components of the electrical connector. These and other objects, features and advantages of the invention will become more apparent from the following description of a preferred embodiment taken in conjunction with the accompanying drawings.

BRIEF DESCRIPTION OF THE DRAWINGS

The presently preferred embodiment of the invention is disclosed in the following description and in the accompanying drawings wherein.

DETAILED DESCRIPTION OF THE PREFERED EMBODIMENT

Figure 1:
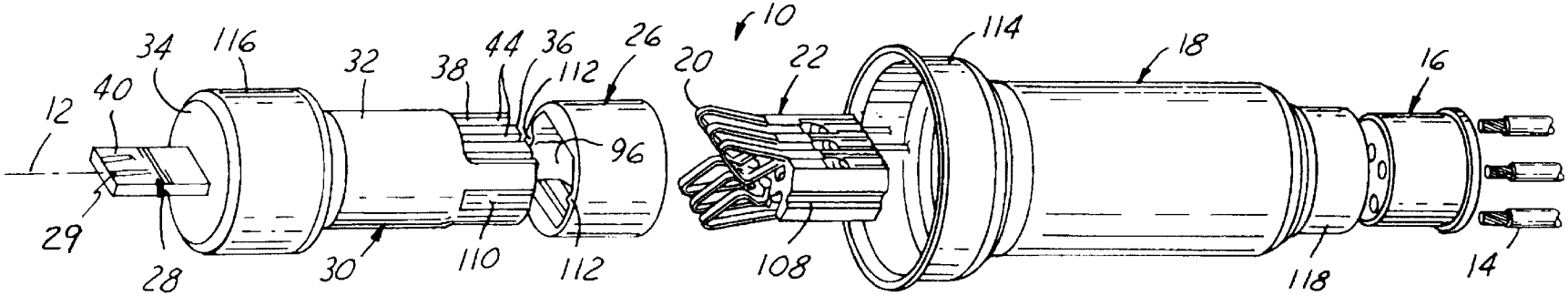
FIG. 1 is an exploded perspective view of an electrical connector of the present invention.
Figure 6:
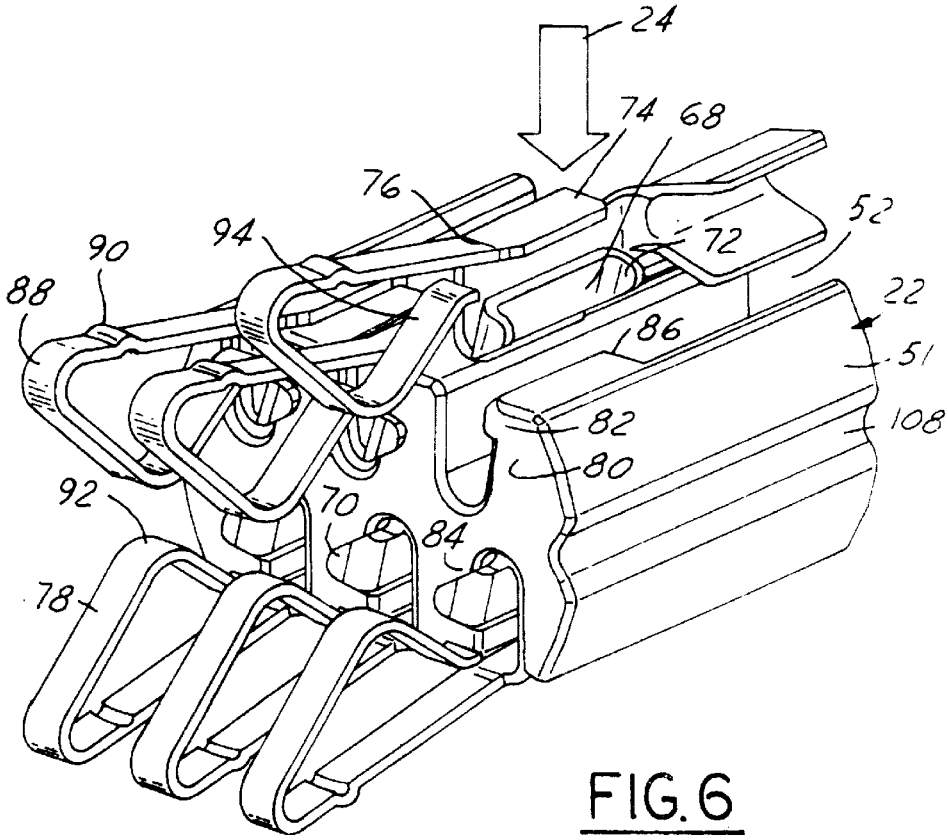
FIG. 6 is an enlarged perspective view of the plurality of terminals and the core.

Referring in more detail to the drawings, FIG. 1 shows a slide contact electrical connector 10 as an integral part of an automotive oxygen sensor. Connector 10 is generally assembled along a common axis 12 wherein a series of insulated wires 14 are routed in a forward direction through a seal 16 which engages a shield 18. The wires 14 are further routed through the shield 18 and then individually crimped to respective metallic terminals 20. The terminals 20 are inserted into a core 22 from a lateral direction, as shown by arrow 24 in FIG. 6. After insertion, the engaged terminals 20 extend forward and flare radially outward beyond the core 22 as shown in FIGS. 1 and 6.

Figure 2:
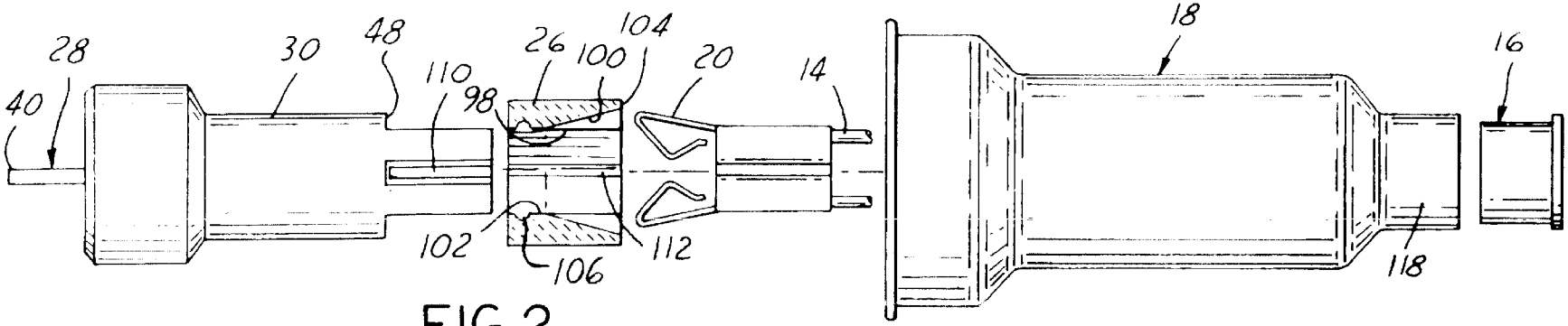
FIG. 2 is an exploded cross section side view of the electrical connector with a plurality of terminals engaged to a core.
Figure 3:
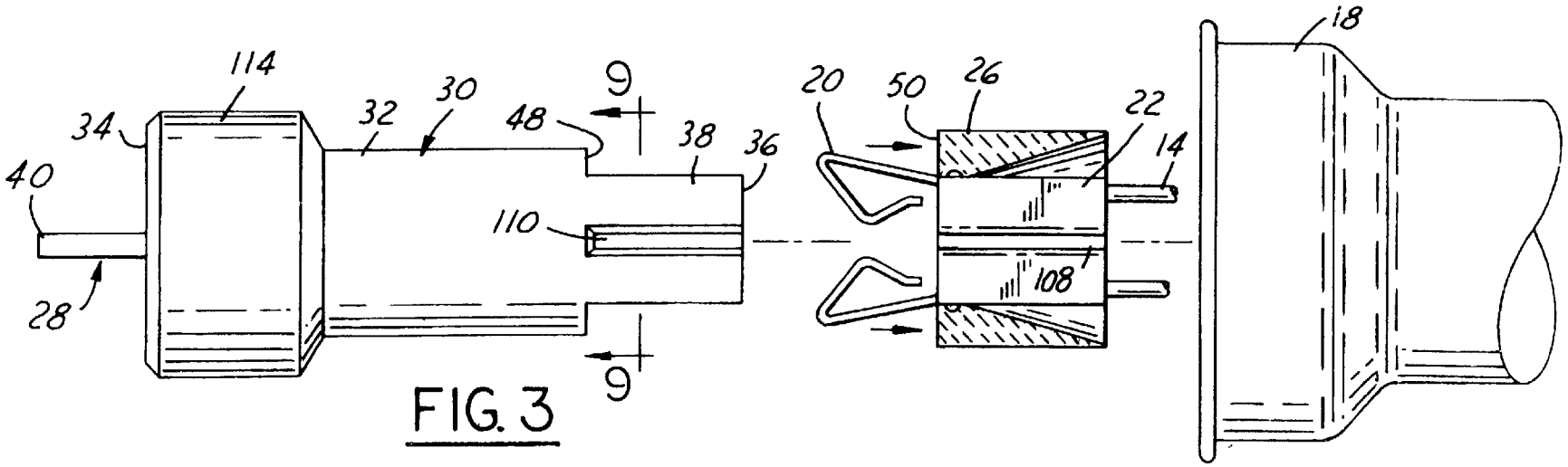
FIG. 3 is a partial exploded cross section side view of the electrical connector showing a collar aligned axially about the core and the plurality of terminals.
Figure 4:
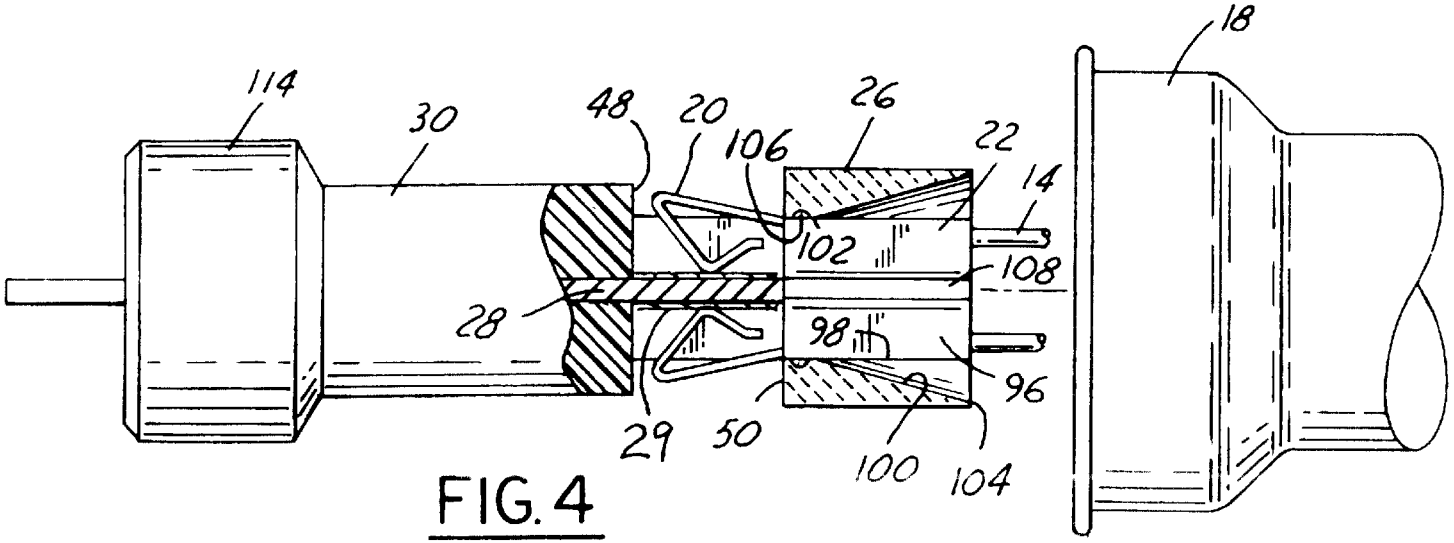
FIG. 4 is a partial exploded cross section side view of the electrical connector showing the terminals disposed laterally about an element.
Figure 8:
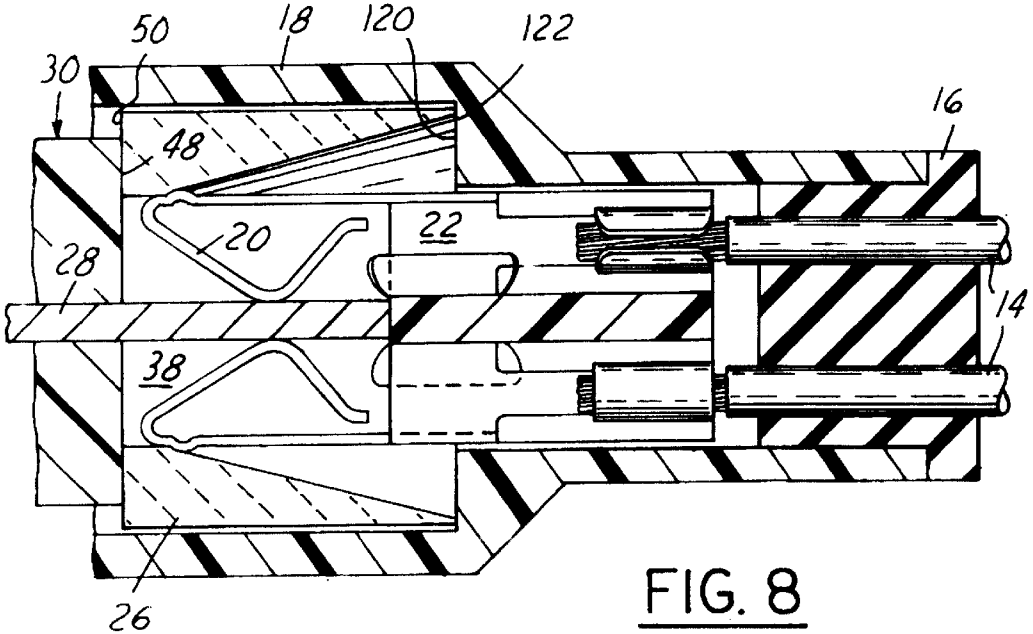
FIG. 8 is an enlarged cross section side view of the terminals engaged fully to the element.

FIGS. 1 and 2 illustrate a collar 26 disposed in front of the flared terminals 20. As shown in FIG. 3, further assembly of the connector 10 entails sliding the collar 26 rearward so that the flared terminals 20 are first compressed within the collar 26 and then released, flaring outward again, as the collar aligns axially to and about the core 22. As shown in FIG. 4, the core 22, the terminals 20, and the collar 26 are then slid axially over and about an edge card or planar element 28 which generally extends through a receptacle plug or capsule 30. The element 28 is preferably a circuit board having multiple metallic contact pads 29 located along one end or edge. As further shown in FIG. 5, the collar 26 is then slid forward from the core 22 and over the capsule 30 compressing the terminals 20 radially inward and laterally against the element 28 thereby making electrical connections with the metallic contact pads 29. To protect the electrical connection, the shield 18 is slid forward along axis 12 with the seal 16 until the shield 18 aligns axially over the capsule 30, the collar 26 and the core 22 as shown in FIG. 8.

The capsule 30, the collar 26, and the core 22 are made of an electrically insulating material. Preferably, if the electrical connector 10 is used in an oxygen sensor application for the exhaust of an automobile, the material is ceramic which is capable of withstanding high temperatures. Since ceramic has sharp comers, the assembly specified above is particularly advantageous because the vulnerable insulation of the wires 14 does not come in contact with or slide past the ceramic material. Therefore the wire insulation is not subject to damaging abrasion or cutting.

Referring to FIGS. 1–3 and 9, the capsule 30 has an outer surface 32 which is preferably and substantially cylindrical and extends between a leading surface 34 and a trailing surface 36. Disposed between the leading and trailing surfaces 34, 36, and defined in part by the trailing surface 36 is an opposite trailing or receptacle portion 38. A leading end 40 of the element 28 penetrates the leading surface 34 of the capsule 30, and an opposite trailing end 42 of the element 28 is exposed laterally through the receptacle portion 38 of the capsule 30 via a series of longitudinally extending slots 44 (shown in FIGS. 1 and 9). Slots 44 generally extend the length of the receptacle portion 38 and communicate through the trailing surface 36. Also, the slots extend radially or laterally from the surface of the trailing end 42 of the element 28 through the outer surface 32.

Preferably, the portion of the outer surface 32 which generally defines the receptacle portion 38 of the capsule 30 has at least one shelf face 46 which extends the length of the receptacle portion 38, from the trailing surface 36 to a collar stop face 48. The shelf face 46 defines the slots 44 and is substantially perpendicular to the trailing surface 36 and the collar stop face 48. Preferably, the element 28 is a flat bar and there are two opposite facing, parallel shelf faces 46 disposed on either side of the lateral faces of the bar. The slots 44 are thereby disposed on and communicate with both sides of the element 28 so that the terminals 20, which partially reside within the slots 44, are in electrical contact with respective contact pads 29 of the planar element or bar 28.

Referring to FIG. 8, the core 22 holds via an interference fit, electrically insulates, and isolates the plurality of terminals 20. The terminals 20 extend forward beyond the core 22 and into the receptacle portion 38 of the capsule 30. In assembly, a forward surface 50 of the collar 26 is in contact with the collar stop face 48 of the receptacle portion 38. When in contact, the collar 26 substantially surrounds the receptacle portion 38 and holds the terminals 20 against the element 28 in order to make the electrical engagement.

Figure 7:
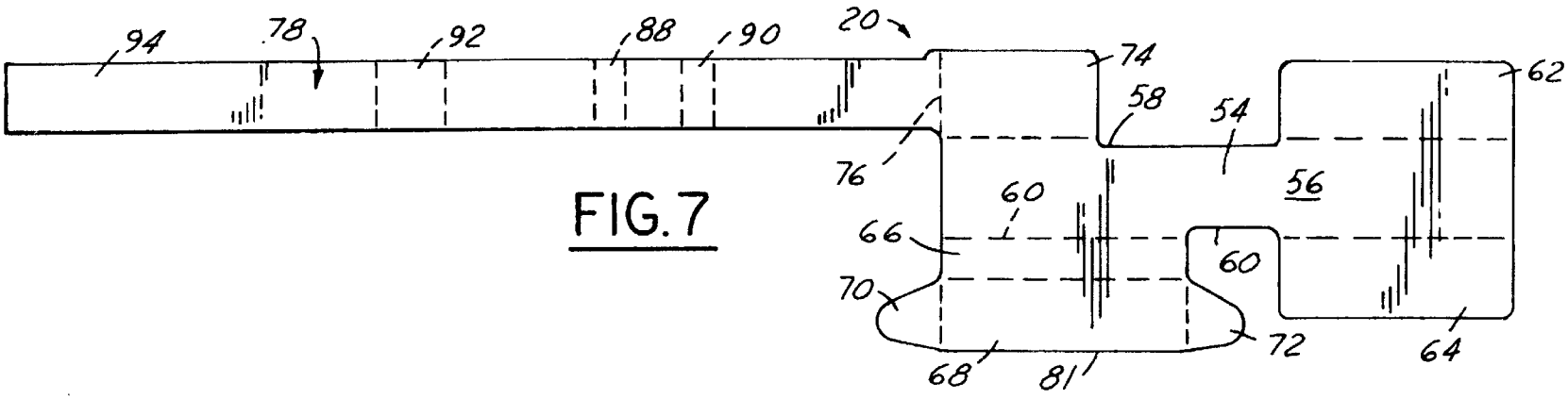
FIG. 7 is a blank view of the terminal.

Referring to FIGS. 6 and 7, the core 22 has an exterior surface 51 which defines a plurality of channels 52 extending in the longitudinal direction of the connector 10 and aligned with the respective slots 44 of the capsule 30. Seated within each channel 52 is a trailing portion 54 of one of the terminals 20. The trailing portion 54 has a base 56 defined by substantially parallel and opposite first and second edges, 58, 60. Congruently attached to a rearward part of the first and second edges 58, 60 are respective first and second crimping tabs 62, 64 which fold over on one another in order to crimp or engage a stripped end of the insulated wire 14. A unitary resilient hinge 66 is disposed congruently between a forward part of the second edge 60 of base 56 and a flap 68. Congruently attached to a forward part of flap 68 is a forward tang 70 and congruently attached to a rearward edge of flap 68 is an opposite or rearward tang 72. Congruently attached to the forward part of first edge 58 of base 56 is a support pad 74 which has a living hinge or forward edge 76. A leading portion 78 of terminal 20 extends flexibly outward from the forward edge 76 of the support pad 74. The support pad 74 is bent along the first edge 58 and is thus disposed substantially perpendicularly to base 56. Likewise, the unitary resilient hinge 66 is disposed substantially perpendicular to base 56 and is substantially parallel and opposes support pad 74. The flap 68 is bent upward from the unitary resilient hinge 66 and is thereby disposed substantially opposite or opposes base 56. Flap 68 extends from hinge 66 to an outer edge 81 extending between the forward and rearward tangs 70, 72.

When properly configured, the terminal 20, with the crimped wire 14 trailing, is snap-fitted into the channel 52 of the core 22 by exerting inward pressure against support pad 74. The base 56 and flap 68 are substantially disposed vertically in a forward portion of channel 52 narrowed at one side by a longitudinally extending elongated projection 80 of the core 22. Projection 80 has an elongated ridge 82 which extends yet further into channel 52 and is disposed at the outward portion of the channel 52 or substantially near the forward surface 50 of the core 22. The ridge 82 extends longitudinally along the channel 52. Snap fitting of terminal 20 results in the resilient folding of flap 68 inward toward the base 56 along hinge 66 as a result of flap 68 contact with ridge 82. When terminal 20 is fully inserted, the outer edge 81 of flap 68 snaps in place beneath ridge 82 within channel 52 thereby locking and preventing outward lateral movement of terminal 20 from the core 22. The forward and rearward tangs 70, 72 of terminal 20 project substantially perpendicular from flap 68. When terminal 20 is fully inserted into channel 52 the forward tang 70 engages a leading side 84 of projection 80 and the rearward tang 72 engages a trailing side 86 of projection 80. This engagement prevents forward or rearward movement or otherwise axial movement of terminal 20 within channel 52 of core 22.

A distal segment 88 of leading portion 78 is disposed both forward and laterally outward from the forward and exterior surfaces 50, 51 of core 22 prior to contact with collar 26. Disposed between the distal segment 88 and the forward edge 76 of the support pad 74 is an outward extending bump 90. Bump 90 is substantially nearer to distal segment 88 than forward edge 76. The leading portion 78 of terminal 20 is bent back laterally inward upon itself at an acute angle from the distal segment 88. Continuing, the leading portion 78 bends again stretching laterally outward forming a contact 92 disposed at the laterally inward most location of the leading portion 78. The remaining portion or trailing length 94 of the leading portion 78 then continues to bend at an angle rearward and back laterally upward toward the support pad 74 or forward edge 76 of the terminal 20 but falling short therefrom.

Referring to FIGS. 2–4, once the terminals 20 are seated within the core 22, the collar 26 is moved axially rearward toward the leading portion 78 of the terminals 20. In order to axially align collar 26 about the core 22, the collar 26 has a hole 96 which extends through the forward surface 50 and is defined by an interior surface 98. The transverse cross sectional area of the hole 96 enlarges in the rearward axial direction from the axial position of the forward surface 50. As the leading portion 78 of the terminals 20 moves through the hole 96 the leading portion 78 of the terminals 20 flex ever increasingly laterally inward at the forward edge 76 until the leading portion 78 protrudes from the forward surface 50 of the collar 26, whereupon the leading portion 78 flares back outward as the collar 26 aligns axially about the core 22. To assist in the flexing of leading portion 78, the interior surface 98 of collar 26 has a ramp 100 for each row of terminals 20. Each ramp 100 extending from a leading longitudinal surface 102 to a trailing edge 104. The ramp 100 flares laterally outward from the surface 102 to the trailing edge 104.

The initial contact of the of distal segment 88 of the leading portion 78 with the ramp 100 of the collar 26 is substantially near the trailing edge 104 and the distal segment 88 slides against the ramp 100 toward the leading surface 102 as the collar 26 moves rearward. While the distal segment 88 slides against the ramp 100, the leading portion 78 flexes laterally inward until the distal segment 88 surpasses the forward surface 50 of collar 26 whereupon the leading portion 78 of terminal 20 is released and once again flares laterally outward as the collar 26 is axially aligned with the core 22.

Figure 9:
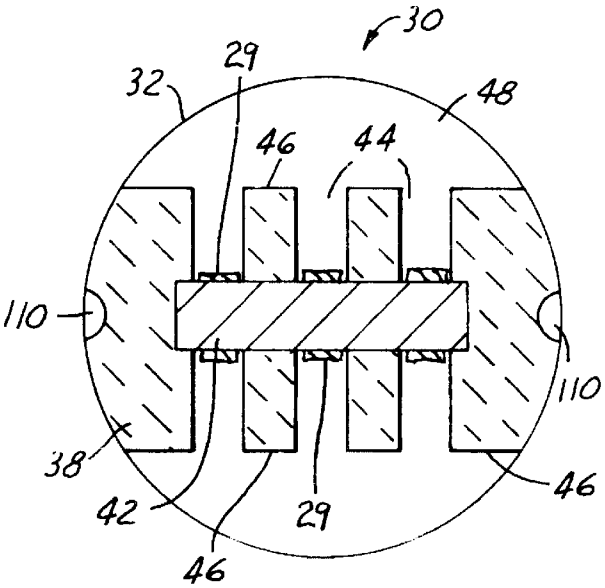
FIG. 9 is a cross section view of a rearward portion of a capsule and the element taken along line 9–9 viewing in the direction of the arrows of FIG. 3.

Referring to FIGS. 4 and 9, once the collar 26 is aligned axially about the core 22, each leading portion 78 of terminals 20 is positioned laterally over the trailing end 42 of element 28 within respective slots 44 of the receptacle portion 38. The terminals 20 are preferably positioned over the element 28 via longitudinal or axial movement, but without coming in actual contact or at least frictional contact with the element 28 itself as shown in FIG. 4. This assures that the precious metals or plating(s) of the contact pads 29 of the element 28 are not scratched or damaged. Preferably, the contacts 92 of terminals 20 are symetrically disposed about the trailing end 42 of the element 28.

Figure 5:
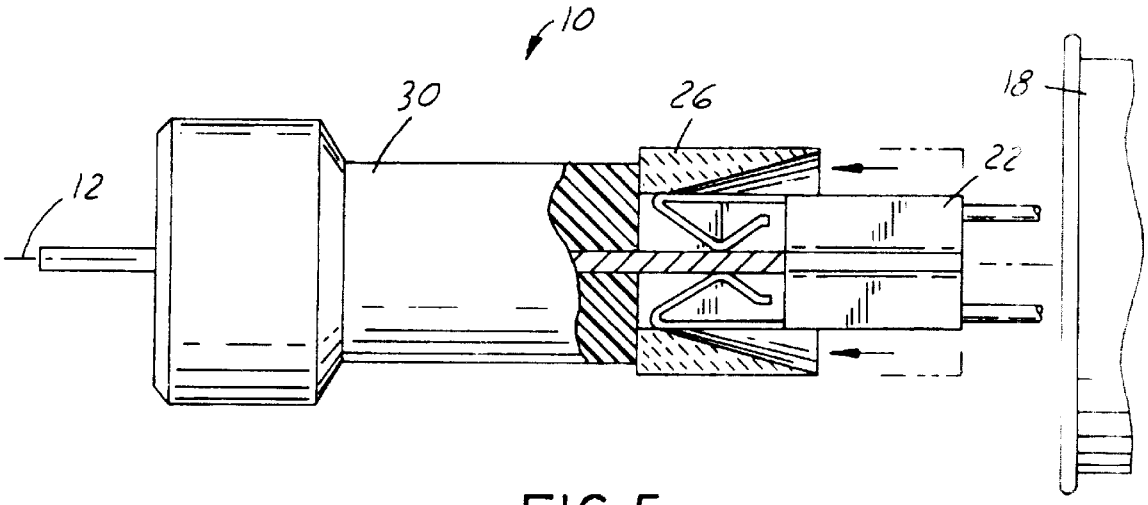
FIG. 5 is a partial exploded cross section side view of the electrical connector showing the collar aligned axially about the element and the plurality of terminals.

Referring to FIGS. 4 and 5, the collar 26 is then moved forward axially away from the core 22. The leading longitudinal surface 102 of the collar 26 makes contact with the exterior surface of leading portion 78 of terminal 20. The leading portion 78 is thereby resiliently compressed against the trailing end 42 of element 28 thereby making electrical contact without scratching or damaging the precious metal surface of trailing end 42. The collar 26 locks in place when the detent or bump 90 of the leading portion 78, as best shown in FIG. 6, mates with a detent recess 106 in the leading longitudinal surface 102 of collar 26.

Referring to FIG. 1, to align the collar 26 to the core 22 and the receptacle portion 38 of the capsule 30, the core 22 and the receptacle portion 38 each have respective longitudinally extending indexing features 108 and 110 which lineup end-to-end. The collar 26 has an indexing features 112 disposed within the hole 96 and extending longitudinally or axially through the collar 26. The indexing features of the collar 112 slide axially along and from the indexing features of the core 22 to and along the indexing features of the receptacle portion 38.

Referring to FIGS. 1 and 8, with the collar 26 aligned axially to the receptacle portion 38 of the capsule 30, the shield 18 is moved axially forward until a flared leading segment 114 of the shield 18 circles and mates with a leading portion 116 of the capsule 30. The diameter of the portion 116 is equal to or larger than the diameter of the collar 26 and remaining trailing portions of the capsule 30. The seal 16, penetrated by the plurality of insulated wires 14, is moved axially forward and press fitted or seated sealably within a trailing segment 118 of the shield 18.

With the shield 18 surrounding the capsule 30, the collar 26, the terminals 20 and the core 22, an interior intermediate annular forward face 120 of the shield 18 preferably engages a rearward surface 122 of the collar 26 thereby securing the collar 26 in place. The shield 18 is then welded or press fitted along the periphery of the portion 116 of the capsule 30. With the shield 18 in place, the seal 16 is press fitted into a trailing end of the shield 18.

Although the preferred embodiment of the present invention has been disclosed, various changes and modifications may be made thereto by one skilled in the art without departing from the scope and spirit of the invention as set forth in the appended claims. For instance, the element 28 need not be a bar and could be a rod. The slots 44 may then be spaced circumferentially apart while extending radially outward. In such an embodiment, the collar stop face 48 would be annular in shape and the interior surface 98 of the collar 26 could take the shape of a frustum. It is also understood that the terms used herein are merely descriptive rather than limiting and various changes may be made without departing from the scope and spirit of the invention.

What is claimed is:

1. An electrical connector for connection to a planar element, the planar element having a trailing end, the trailing end being insertable into the connector, the electrical connector comprising:

a core;

a longitudinally extending terminal having a longitudinally extending cantilevered leading portion and a trailing portion, the trailing portion engaged to the core, the leading portion having a distal segment and a contact both disposed axially forward of the core, the distal segment disposed laterally outward from the contact, the contact engaged resiliently and electrically to the trailing end of the element;

a collar aligned axially to and radially outward from the trailing end of the element, the distal segment of the leading portion engaged resiliently to and disposed laterally inward from an interior surface of the collar, wherein the engagement of the collar against the distal segment of the terminal creates normal forces that exert upon the element by the contact of the terminal; and an elongated capsule having a receptacle portion, the trailing end of the element embedded longitudinally within the receptacle portion, the contact of the terminal electrically contacting the trailing end laterally through the receptacle portion.

2. The electrical connector as set forth in claim 1 wherein the interior surface of the collar has a ramp aligned axially with the receptacle portion of the capsule and flared radially outward from a leading surface to a rearward edge of the ramp, the distal segment of the terminal engaged resiliently against and laterally inward from the leading surface of the ramp.

3. The electrical connector as set forth in claim 2 wherein there are a plurality of longitudinally extending terminals that include the longitudinally extending terminal.

4. The electrical connector as set forth in claim 3 wherein the receptacle portion of the capsule has a plurality of slots extending longitudinally along the receptacle portion and communicating longitudinally through a trailing surface of the capsule, the leading portion of each one of the plurality of terminals disposed in each respective one of the plurality of slots.

5. The electrical connector as set forth in claim 4 further comprising:

a plurality of channels defined by an exterior surface of the core, the trailing portion of each one of the plurality of terminals disposed longitudinally in each respective one of the plurality of channels;

a plurality of projections of the core, each one of the plurality of projections extended within each respective one of the plurality of channels, each one of the plurality of projections having a leading side and a trailing side; and the trailing portion of each one of the plurality of terminals having a forward tang and a rearward tang, the forward tang engaged to the leading side and the rearward tang engaged to the trailing side of each respective one of the plurality of projections preventing forward or rearward movement of the plurality of terminals with respect to the core.

6. The electrical connector as set forth in claim 5 further comprising:

a ridge of each one of the plurality of projections, the ridge extended transversely into each respective one of the plurality of channels, the ridge extended longitudinally between the leading and trailing sides of each one of the plurality of projections; and a flap of the trailing portion of each one of the plurality of terminals, the flap having an outward edge extended between the forward and rearward tangs, the outward edge engaged to the ridge from beneath.

7. The electrical connector as set forth in claim 6 wherein each distal segment of the plurality of terminals have an outward facing bump and the ramp has a mating detent to lock the collar to the plurality of terminals.

8. The electrical connector as set forth in claim 7 wherein the exterior surface of the core defines at least one longitudinally extending indexing feature mating with at least one indexing feature disposed on the receptacle portion of the capsule, the at least one indexing feature of the receptacle portion aligned longitudinally and end to end with the at least one indexing feature of the core.

9. The electrical connector as set forth in claim 8 further comprising:

a plurality of insulated wires electrically engaged to the trailing portions of the respective plurality of terminals;

an end seal penetrated by the plurality of wires; and a shield disposed radially outward and circling the collar, the core, the plurality of terminals, and the capsule, the shield having a forward face in contact with a rearward face of the collar, the shield thereby holding the collar axially in place with the receptacle portion of the capsule.

10. A method of assembling a slide contact electrical connector comprising the steps of:

electrically engaging each one of a plurality of insulated wires to respective trailing portions of a plurality of terminals;

inserting laterally the trailing portions of the plurality of terminals into a plurality of slots of a core;

pre-mounting a collar about the core from a pre-forward position to a trailing position;

positioning leading portions of the plurality of terminals about a trailing end of an elongated element within a plurality of channels defined by a trailing portion of an elongated capsule, and without making resilient contact by the terminals with the element; and placing the collar from the trailing position to a forward position, laterally biasing the leading portions of the plurality of terminals symmetrically about and electrically against the trailing end of an elongated element.

11. The method of assembling the electrical connector as set forth in claim 10 further comprising the steps of:

routing the plurality of wires through an end seal prior to engaging the plurality of wires to the plurality of terminals;

routing the plurality of wires through a shield;

welding the shield to a portion of the capsule; and engaging the end seal to the shield.

* * * * *